US010222026B2

(12) United States Patent
Kim et al.

(10) Patent No.: US 10,222,026 B2
(45) Date of Patent: Mar. 5, 2019

(54) INDIRECT LED LIHTING APPARATUS HAVING A REFLECTION CONFIGURATION

(71) Applicant: KMW INC., Hwaseong, Gyeonggi-Do (KR)

(72) Inventors: Duk-Yong Kim, Gyeonggi-do (KR); Myeong-Kyu Ryu, Gyeonggi-do (KR); Myoung-Seo Park, Gyeonggi-Do (KR); Seung-Bum Yoo, Gyeonggi-do (KR)

(73) Assignee: Gigatera Inc., Hwaseong-si (KR)

( * ) Notice: Subject to any disclaimer, the term of this patent is extended or adjusted under 35 U.S.C. 154(b) by 0 days.

(21) Appl. No.: 15/390,166

(22) Filed: Dec. 23, 2016

(65) Prior Publication Data

US 2017/0108194 A1 Apr. 20, 2017

Related U.S. Application Data

(63) Continuation of application No. PCT/KR2015/006182, filed on Jun. 18, 2015.

(30) Foreign Application Priority Data

Jun. 25, 2014 (KR) ..... 10-2014-0078331

(51) Int. Cl.

| | |
|---|---|
| ***F21V 7/00*** | (2006.01) |
| ***F21S 8/04*** | (2006.01) |
| ***F21V 7/04*** | (2006.01) |
| ***F21S 8/00*** | (2006.01) |
| ***F21V 3/02*** | (2006.01) |

(Continued)

(52) U.S. Cl.

CPC ..... *F21V 7/0008* (2013.01); *F21S 8/033* (2013.01); *F21S 8/04* (2013.01); *F21V 3/02* (2013.01); *F21V 7/04* (2013.01); *F21V 23/005* (2013.01); *F21Y 2115/10* (2016.08)

(58) Field of Classification Search

CPC .. F21V 7/0008; F21V 7/0016; F21Y 2115/10; F21S 8/033

See application file for complete search history.

(56) References Cited

U.S. PATENT DOCUMENTS 4,748,543 A * 5/1988 Swarens ..... F21S 8/02 362/147
6,257,737 B1 * 7/2001 Marshall ..... F21S 8/04 362/231

(Continued)

*Primary Examiner* — Robert J May

(74) *Attorney, Agent, or Firm* — Mintz Levin Cohn Ferris Glovsky and Popeo, P.C.; Kongsik Kim; Jhongwoo Jay Peck

(57) ABSTRACT

The present invention relates to an indirect lighting apparatus using an LED, comprising: a case unit provided along the perimeter of the upper part of a wall surface, and having a light emitting opening on a side opposite to the wall surface; a substrate mounted with an LED and provided at the innermost side of the inner bottom surface of the case unit; a light distributing unit for distributing light to the ceiling through the light emitting opening by reflecting the light emitted from the LED; and a cover unit for covering the light emitting opening of the case unit. The present invention uses a simple structure so that the apparatus is fixedly provided on the wall surface, and can be used as main lighting or mood lighting by providing the distributed light capable of selectively illuminating the entire ceiling.

9 Claims, 5 Drawing Sheets

(51) Int. Cl.
*F21V 23/00* (2015.01)
*F21Y 115/10* (2016.01)

(56) References Cited

U.S. PATENT DOCUMENTS

| | | | | |
|---|---|---|---|---|
| 8,002,434 | B2 * | 8/2011 | Sommers | A47F 3/001 362/241 |
| 8,197,105 | B2 * | 6/2012 | Yang | A47F 3/001 362/346 |
| 8,425,101 | B2 * | 4/2013 | Boonekamp | F21V 7/0008 362/609 |
| 8,721,131 | B2 * | 5/2014 | Miyairi | F21V 7/0008 362/217.05 |
| 2008/0204888 | A1 * | 8/2008 | Kan | F21S 8/026 359/629 |
| 2008/0247170 | A1 * | 10/2008 | Peck | F21V 7/0008 362/297 |

* cited by examiner

INDIRECT LED LIHTING APPARATUS HAVING A REFLECTION CONFIGURATION

CROSS-REFERENCE TO RELATED APPLICATIONS

This application is a continuation application if International Application No. PCT/KR2015/006182 filed on Jun. 18, 2015, which claims priority to Korean Application No. 10-2014-0078331 filed on Jun. 25, 2014. The applications are incorporated herein by reference.

TECHNICAL FIELD

The present disclosure relates to an indirect lighting apparatus using an LED (light emitting diode), and more particularly, to an indirect lighting apparatus using an LED which can be used as a mood light or indirect ceiling lighting.

BACKGROUND ART

Lighting apparatuses using LEDs as light sources are being developed in consideration of problems of typical light source means, such as high power consumption, short lifetime, and the like. In the case where an LED is used as a light source, it is expected that, because the lifetime of a lighting apparatus is markedly increased compared to that of a typical light source, the amount of waste production is markedly reduced so that environmental contamination can be reduced, and it can contribute to energy conservation thanks to low power consumption.

However, the LED is a point type light source. Thus, to use the LED as a non-dazzling light source, it must have a structure that can realize a surface-emitting device. Typically, for indoor lighting, the lighting apparatus using the LED is installed on a ceiling.

Such lighting is called direct lighting. Indirect lighting refers to a method in which light is emitted onto a ceiling or wall surface and the reflected light is used for indoor lighting.

An example of a conventional indirect lighting apparatus using an LED was proposed in Korean Patent Registration No. 10-1015257 (registered on Feb. 9, 2011, and entitled "Lamp for indirect lighting apparatus using LED").

The lamp for an indirect lighting apparatus disclosed in Korean Patent Reg. No. 10-1015257 includes a main body having an arc-shaped cross-section, a PCB (printed circuit board) provided in the main body, a fixing bracket capable of adjusting the angle of the main body, and an adhesion member coming into surface contact with a sidewall of a connection frame which is embedded in a ceiling or wall.

That is, the connection frame is embedded in a portion of the wall or ceiling, and a bar-type LED lighting unit (main body) is supported by the fixing bracket fixed in the connection frame by the adhesion member.

However, the conventional indirect lighting apparatus is basically installed in such a way that it is embedded in the wall surface; therefore, it can be installed on only a certain portion of the wall surface. Thus, the conventional indirect lighting apparatus is used only when there is the need for mood lighting or low-luminance lighting in a room with a separate direct lighting apparatus.

In other words, the conventional indirect lighting apparatus must be installed separately from a main lighting apparatus. Accordingly, there is a problem in that the installation cost of a lighting system is increased. Given this, a lighting apparatus, configured such that a single lighting apparatus can be used not only for mood lighting but also for main lighting, is currently required.

SUMMARY

Various embodiments are directed to an indirect lighting apparatus using an LED which is configured such that a single lighting apparatus can be used for mood lighting or main lighting, as needed.

Also, various embodiments are directed to an indirect lighting apparatus using an LED which can provide main lighting regardless of the area of a room, despite having a simple structure.

In an embodiment, there is provided an indirect lighting apparatus using an LED, including: a case unit installed along the perimeter of an upper of a wall surface, and having a light emitting opening formed on a side opposite to the wall surface; a substrate installed at an innermost side of an inner bottom surface of the case unit, with an LED mounted on the substrate; a light distribution unit configured to reflect light emitted from the LED and distribute the light onto a ceiling through the light emitting opening; and a cover unit configured to cover the light emitting opening of the case unit.

An indirect lighting apparatus using an LED according to the present invention uses a simple structure which is allowed to be installed on a wall surface, and can be used for main lighting or mood lighting by providing distributed light capable of selectively illuminating the entirety of a ceiling.

DETAILED DESCRIPTION

Hereinafter, an indirect lighting apparatus using an LED according to the present disclosure will be described in detail with reference to the attached drawings.

Figure 1:
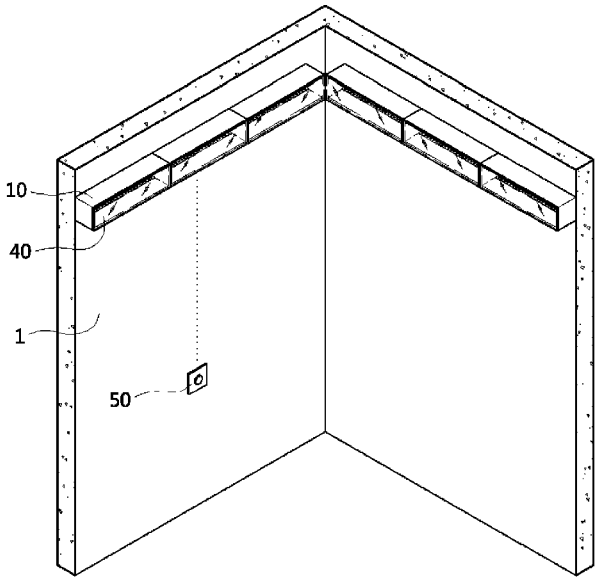
FIG. 1 is a view illustrating installation of an indirect lighting apparatus using an LED according to an embodiment of the present disclosure.
Figure 2:
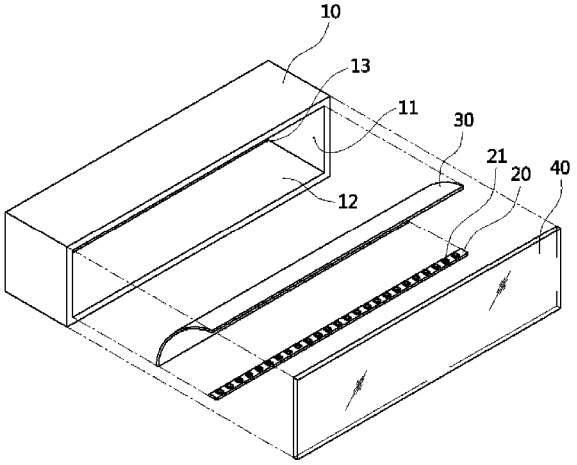
FIG. 2 is an exploded perspective view illustrating the indirect lighting apparatus using the LED according to the embodiment of the present disclosure.
Figure 3:
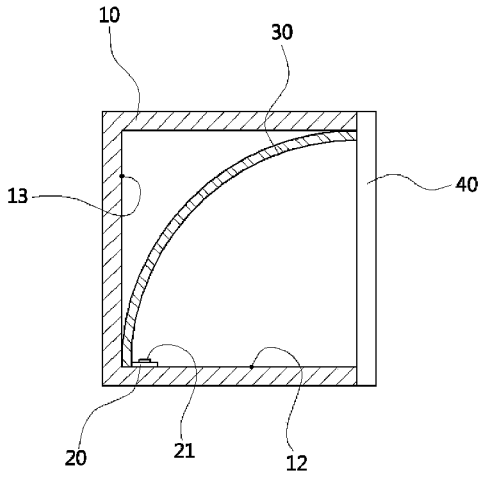
FIG. 3 is a sectional view illustrating the configuration of the indirect lighting apparatus using the LED according to the embodiment of the present disclosure.

FIG. 1 is a view illustrating installation of an indirect lighting apparatus using an LED according to an embodiment of the present disclosure, FIG. 2 is an exploded perspective view illustrating the indirect lighting apparatus using the LED according to the present disclosure, and FIG. 3 is a sectional view illustrating the configuration of the present disclosure.

Referring to FIGS. 1 to 3, the indirect lighting apparatus using the LED according to the embodiment of the present disclosure includes: a case unit 10 installed along the perimeter of an upper part of a wall surface 1, and having a light emitting opening 11 on a side thereof opposite to the wall surface 1; a substrate 20 mounted with an LED, and provided at the innermost side of an inner bottom surface of the case unit 10; a light distribution unit 30 which reflects light emitted from the LED 21 and distributes the light to a ceiling through the light emitting opening 11; and a cover unit 40 which covers the light emitting opening 11 of the case unit 10.

Hereinbelow, the configuration and operation of the indirect lighting apparatus using the LED according to the embodiment of the present disclosure having the above-mentioned configuration will be described in more detail.

The case unit 10 has a hollow hexahedral case structure having a long length and is installed, making contact with the upper part of the wall surface 1. The case unit 10 is installed such that the light emitting opening 11 faces the side opposite to the wall surface 1.

It is preferable that the case unit 10 be installed such that an upper corner thereof come into contact with the wall surface 1 and the ceiling or be disposed at a position below the ceiling by 5 cm to 15 cm.

The installation position of the case unit 10 is a position at which light of from the LED 21 that is distributed through the light emitting opening 11 can be easily illuminated onto the ceiling.

A plurality of case units 10 may be installed on all wall surfaces 1 along the entirety of the perimeter of the ceiling, or may be installed on three wall surfaces 1 other than one side wall surface. Although, in this embodiment, there is illustrated the case which the case unit 10 has a hexahedral structure, the present disclosure is not limited to this. That is, the case unit 10 may be embodied in various shapes. However, the hexahedral structure is most advantageous in terms of the production cost and ease of manufacture.

A plurality of LEDs 21 are mounted on the substrate 20. The substrate 20 is fixed on the inner bottom surface 12 of the case unit 10 at the innermost position.

The reason why the substrate 20 mounted with the LEDs 21 is disposed at the innermost position is because distribution of light to the ceiling is facilitated, and light of the LEDs 21 can be prevented from being directly applied to the eyes of a user in consideration of the fact that, if the light of the LED 21 is directly applied to the eyes of the user, only a corresponding portion may look excessively bright.

Power is supplied to the substrate 20 from a DC power supply embedded in the wall surface 1. A controller 50 for controlling the DC power supply is provided on the wall surface 1. Dimming control and/or color temperature control of the LEDs 21 is possible by controlling the DC power supply using the controller 50.

As such, by controlling the LEDs 21, the entirety of the ceiling may be selected as a light applied area so that the lighting apparatus can be used for main lighting, or only portion of the ceiling that is adjacent to the wall surface 1 may be used as a light applied area so that mood lighting can be provided.

Light emitted from the LEDs 21 is reflected by the light distribution unit 30 having an arc-shaped cross-section and applied to the ceiling through the light emitting opening 11.

The lower surface of the light distribution unit 30 is a reflective surface and has a curved shape with a predetermined curvature. A light distribution pattern along which light is distributed onto the ceiling is formed by the curvature.

A lower end of the light distribution unit 30 is fixed to a lower end of an inner vertical surface 13 of the casing unit 10, and an upper end thereof is fixed to a portion of the casing unit 10 over the light emitting opening 11.

As shown in the sectional view of FIG. 3, the light distribution unit 30 is disposed in a diagonal direction of the case unit 10 and has an arc shape with a predetermined curvature such that the lower surface thereof is concave.

Figure 4:
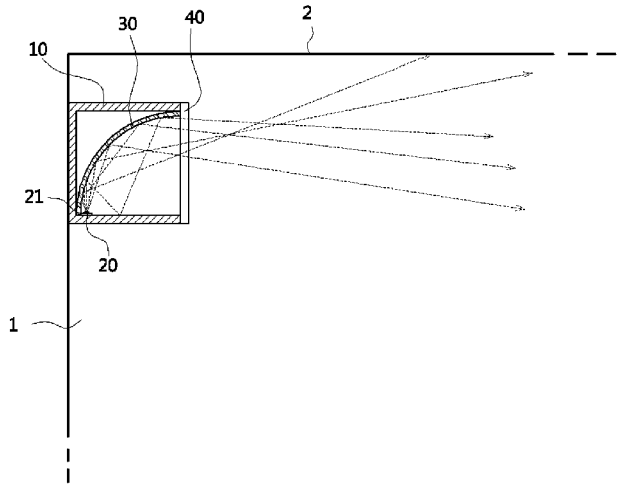
FIG. 4 is a schematic view illustrating light distribution of the indirect lighting apparatus using the LED according to the present disclosure.

FIG. 4 is a schematic view illustrating the light distribution of the indirect lighting apparatus using the LED according to the present disclosure.

Referring to FIG. 4, in the indirect lighting apparatus using the LED according to the present disclosure, distributed light spreads widely and is applied to the ceiling. The distributed light that is applied to the ceiling is reflected by the ceiling and is indirectly illuminated into the room.

In more detail, light emitted from the plurality of LEDs 21 mounted on the substrate 20 is reflected by the light distribution unit 30, and some of the reflected light is directly distributed onto the ceiling through the light emitting opening 11, and the other reflected light is reflected by the inner bottom surface 12 of the case unit 10 again and distributed onto the ceiling or reflected by the light distribution unit 30 again and then distributed onto the ceiling.

The light of the LEDs 21 that has been distributed onto the ceiling is reflected by the ceiling again and then illuminated into the room.

If the LEDs 21 is controlled by the controller 50 such that the brightness thereof is increased, the brightness of light that is distributed onto the ceiling is also increased. Thereby, the present disclosure that is used for indirect lighting may be used for main lighting.

Furthermore, if the LEDs 21 is controlled by the controller 50 such that the brightness thereof is reduced, there is a clear difference in light quantity between the perimeter of the ceiling that is adjacent to the wall surface 1 and the central portion of the ceiling. Therefore, the present disclosure can provide mood lighting since light is distributed onto only the portion of the ceiling that is adjacent to the wall surface 1.

Figure 5:
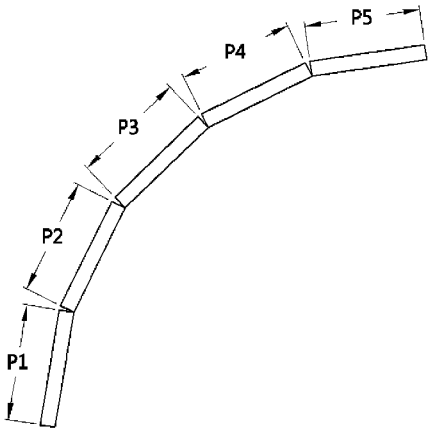
FIG. 5 is a sectional view illustrating the configuration of a light distribution unit of an indirect lighting apparatus using an LED according to another embodiment of the present disclosure.

FIG. 5 is a sectional view illustrating the configuration of a light distribution unit 30 of an indirect lighting apparatus using an LED according to another embodiment of the present disclosure.

Referring to the sectional view of FIG. 5, the light distribution unit 30 includes a plurality of segmentations P1 to P5 having different curvatures. Depending on the curvatures and angles of the respective segmentations P1 to P5, distributed light may be applied farther to the ceiling. Therefore, light may be easily incident on the central portion of the ceiling.

Each of the segmentations P1 to P5 may have a curved surface or an inclined planar surface.

Referring again to FIG. 4, the cover unit 40 is formed of a transparent plate. The cover unit 40 can prevent light emitted from the LEDs 21 from being directly distributed depending on the positions of the LEDs 21 and the structure of the light distribution unit 30, in a similar manner to that described above, thus preventing the user from being dazzled. Therefore, intended lighting is achieved without use of a separate lens for surface emitting. Consequently, a reduction in light efficiency can be prevented.

While various embodiments have been described above, it will be understood to those skilled in the art that the embodiments described are by way of example only. Accordingly, the disclosure described herein should not be limited based on the described embodiments.

The invention claimed is:

1. An indirect lighting apparatus using a light emitting diode (LED), comprising:

a case unit configured to be installed a wall surface, wherein the case unit has a bottom surface, a top surface, a vertical surface that is connected to the bottom surface and the top surface, and a light emitting opening formed on a side opposite to the wall surface;

a substrate installed at an innermost side of an inner bottom surface of the case unit, with an LED mounted on the substrate;

a light distribution unit separately provided within the case unit and configured to reflect light emitted from the LED and distribute the light onto a ceiling through the light emitting opening, wherein a lower end of the light distribution unit is fixed to a lower end of an inner vertical surface of the case unit and an upper end of the light distribution unit is fixed to an outermost end of an inner top surface of the case unit, and wherein the light distribution unit includes a plate having a concave lower surface with a predetermined curvature such that the light emitted from the LED is distributed onto the ceiling; and a cover unit configured to cover the light emitting opening of the case unit.

2. The indirect lighting apparatus according to claim 1, wherein the light distribution unit comprises a plate having a concave lower surface with a predetermined curvature such that the light emitted from the LED is distributed onto the ceiling, and includes a plurality of segmentations having different inclinations or curvatures.

3. The indirect lighting apparatus according to claim 2, wherein the substrate mounted with the LED is installed on the inner bottom surface of the case unit at a position distant from the light emitting opening.

4. The indirect lighting apparatus according to claim 3, wherein a direct current (DC) power supply is applied to the substrate mounted with the LED, and wherein dimming control and/or color temperature control of the LED is performed by controlling the DC power supply using a controller.

5. The indirect lighting apparatus according to claim 1, wherein the substrate mounted with the LED is installed on the inner bottom surface of the case unit at a position distant from the light emitting opening.

6. The indirect lighting apparatus according to claim 5, wherein a direct current (DC) power supply is applied to the substrate mounted with the LED, and wherein dimming control and/or color temperature control of the LED is performed by controlling the DC power supply using a controller.

7. The indirect lighting apparatus according to claim 1, wherein the substrate mounted with the LED is installed on the inner bottom surface of the case unit at a position distant from the light emitting opening.

8. The indirect lighting apparatus according to claim 7, wherein a direct current (DC) power supply is applied to the substrate mounted with the LED, and wherein dimming control and/or color temperature control of the LED is performed by controlling the DC power supply using a controller.

9. The indirect lighting apparatus according to claim 1, wherein the case unit has a hollow hexahedral structure that is open on one surface thereof to form the light emitting opening.

* * * * *